US006581572B1

(12) United States Patent
Hurley et al.

(10) Patent No.: US 6,581,572 B1
(45) Date of Patent: Jun. 24, 2003

(54) ENGINE FUELLING RATE CONTROL

(75) Inventors: Richard William Hurley, Glen Waverley (AU); Martin David Hughes, Wembley Downs (AU)

(73) Assignee: Orbital Engine Company (Australia) Pty Limited, Balcatta (AU)

( * ) Notice: Subject to any disclaimer, the term of this patent is extended or adjusted under 35 U.S.C. 154(b) by 0 days.

(21) Appl. No.: 09/147,479

(22) PCT Filed: Jul. 10, 1997

(86) PCT No.: PCT/AU97/00442

§ 371 (c)(1),
(2), (4) Date: Jan. 7, 1999

(87) PCT Pub. No.: WO98/01660

PCT Pub. Date: Jan. 15, 1998

(30) Foreign Application Priority Data

Jul. 10, 1996 (AU) ..... PO 0949

(51) Int. Cl.[7] ..... F02D 41/04

(52) U.S. Cl. ..... 123/478; 701/104; 701/105; 123/480

(58) Field of Search ..... 123/478, 480, 123/486, 492, 493, 399, 361, 403; 701/102, 104, 105

(56) References Cited

U.S. PATENT DOCUMENTS

| | | | | | |
|---|---|---|---|---|---|
| 3,554,170 | A | * | 1/1971 | Schenk et al. | 123/305 |
| 4,359,991 | A | | 11/1982 | Stumpp et al. | 123/478 |
| 4,633,841 | A | | 1/1987 | Matsuura et al. | 123/492 |
| 4,932,371 | A | * | 6/1990 | Albertson et al. | 123/403 |
| 4,971,011 | A | | 11/1990 | Nanyoshi et al. | 123/436 |
| 4,986,245 | A | | 1/1991 | Nakaniwa et al. | 123/492 |
| 5,080,064 | A | * | 1/1992 | Buslepp et al. | 123/399 |
| 5,251,597 | A | * | 10/1993 | Smith et al. | 123/585 |
| 5,282,448 | A | * | 2/1994 | Reinke et al. | 123/403 |
| 5,372,110 | A | * | 12/1994 | Boverie et al. | 123/361 |
| 5,540,205 | A | * | 7/1996 | Davis et al. | 123/486 |
| 6,058,906 | A | * | 5/2000 | Yoshino | 123/295 |

FOREIGN PATENT DOCUMENTS

| | | | | |
|---|---|---|---|---|
| EP | 0413 432 A2 | * | 2/1991 | F02D/41/14 |
| EP | 0 279 375 B1 | | 5/1992 | |
| EP | 0 511 701 A1 | * | 11/1992 | F02D/41/26 |
| GB | 2066513 | | 7/1981 | |

* cited by examiner

*Primary Examiner*—Hieu T. Vo
(74) *Attorney, Agent, or Firm*—Arent Fox Kintner Plotkin & Kahn, PLLC

(57) ABSTRACT

A method for controlling the fuelling rate for an internal combustion engine including: a) controlling the fuelling rate in a fuel led control mode whereby the fuelling rate is controlled as a function of the operator demand on the engine during at least a portion of low engine load operation; b) controlling the fuel rate in an air led control mode whereby the fuelling rate is controlled as a function of the air flow rate to the engine during at least a portion of medium-to-high engine load operation; and c) providing a point of transition between the two control modes wherein each control mode provides substantially the same predetermined fuelling rate.

18 Claims, 2 Drawing Sheets

ENGINE FUELLING RATE CONTROL

Figure 1:
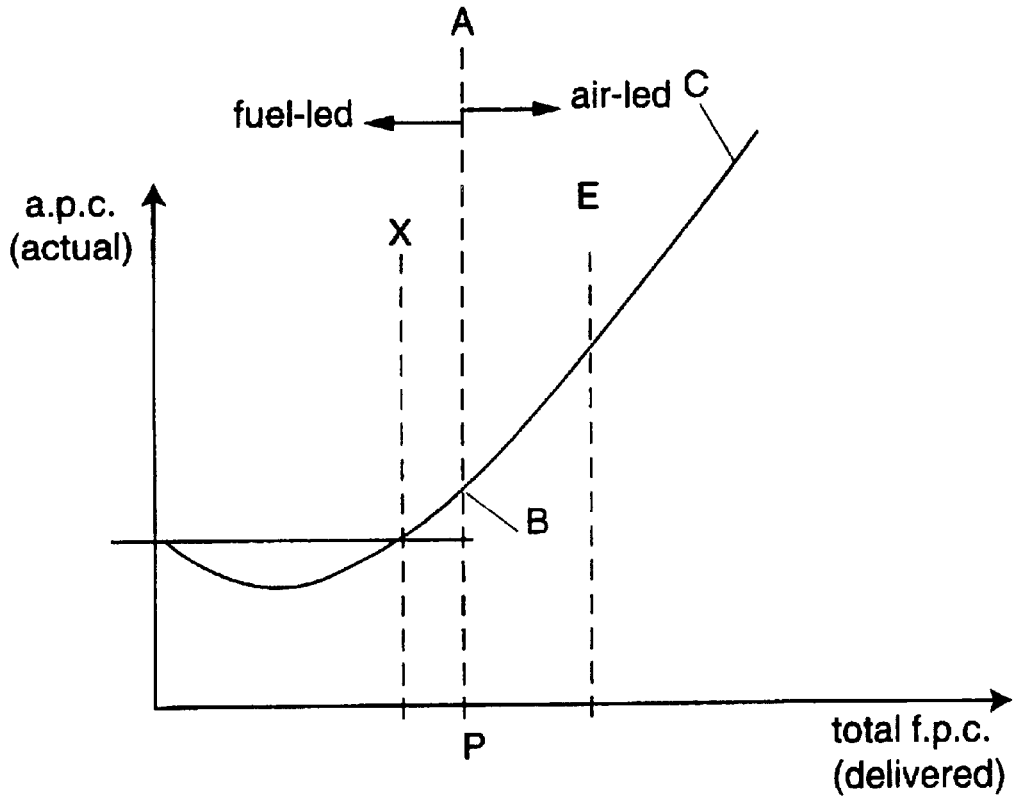

The present invention generally relates to the control of the fuelling rate of internal combustion engines, and in particular to engines in which fuelling level and air flow level may be controlled independently, for example where fuel is supplied via electronically controlled fuel injection. In this specification, reference will be made to fuel delivery per cycle (fpc) and air flow per cycle (apc). A reference to either apc or fpc may refer to the level of fuelling/air flow determined to be required for appropriate operation of the engine (the "demand" apc/fpc), or to the fuel/air actually delivered to the engine, or to any other measure of air flow or fuelling level as the context requires.

In many internal combustion engines, such as carburettor fuelled four stroke engines, the relationship between air flow rate and fuelling rate is substantially monotonic. In these engines, each air flow rate value corresponds to a single fuelling rate value. Engines having this characteristic are able to operate under what is known as air led control. In air led control, an air flow rate is set by driver demand, and fuelling level is subsequently determined as a function of the air flow rate to the engine.

It is however not-normally possible to use such control in internal combustion engines having an air flow/fuelling level characteristic which provides non-unique values of fuelling level for a given air flow. One example of an engine having such a characteristic is the applicant's fuel injected two stroke crankcase scavenged engine. In this engine, airflow to the engine actually decreases with initial increases in fuelling level (or rate) before rising, as fuelling level increases further, to above the initial air flow rate. It can be seen that it is possible to obtain non-unique values for fuelling rate for a single air flow rate. Many variations providing non-unique values are possible. For example, initial increases in fuelling may correspond to substantially no change in airflow. It is therefore not generally possible to use air led control of the fuelling rate at low engine loads in such engines.

The Applicant's Australian Patent Application No. 34862/93, describes a method for controlling the fuelling rate of an internal combustion engine, in particular a fuel injected two stroke engine, where a fuelling rate, or "Demand_FPC" is initially determined and the required air flow rate, or "Demand_APC" is subsequently determined on the basis of the Demand_FPC value. This method of controlling the fuelling rate is referred to as fuel led control. The Demand_FPC is determined as a function of operator demand as measured, for example, by sensing the throttle pedal position and the engine speed. The Demand_FPC can then be determined by means of a look-up map provided within the engine management system plotting the Demand_FPC against the coordinates of pedal position and engine speed. This look-up map is known as the "pedal" map because the driver initiated fuelling level is assessed by determining the operator pedal position. The Demand_APC for the above determined Demand_FPC is then determined using a look-up map plotting Demand_APC against the coordinates of Demand_FPC and engine speed. The determined Demand_APC is then compared with the measured air supply rate to the engine, or Measured_APC, as measured by an air mass sensor and, if possible, the air mass flow rate adjusted to compensate for any difference between the two. The resultant air/fuel ratio of Demand_FPC against Demand_APC can also be compared with a censor air/fuel ratio which is preset on the basis of the engine load demand and engine speed. The censor air/fuel ratios are stored on a further look-up map and set predetermined minimum limits to the air/fuel ratio that can be applied for the existing speed and load. These limits to the air/fuel ratio are set to prevent specific engine malfunctions such as engine misfire, and take into account catalyst and/or emission considerations. If it is determined that the air fuel ratio is too low (ie rich mixture), the fuel supply may be clipped to avoid delivery of such rich mixtures to the engine.

Fuel led operation may be disadvantageous in certain situations. In certain types of fuelling systems, such as those using fuel injectors, fuelling level can be altered quickly and accurately, whilst variation of the air flow rate is generally less accurate, slower and more difficult to control, particularly under transient conditions, making control of the air fuel ratio in the combustion chamber more difficult. Supplying air and fuel at an accurate air fuel ratio is important for controlling combustion emissions. As such, it is preferable to have the airflow being set by driver demand and then to control the fuelling level to give the required air fuel ratio, that is, air led control.

Another advantage of using air led control at higher load/speed occurs at or near wide open throttle (WOT) conditions where air led control can be used to achieve maximum power output from the engine. In fuel led operation, calculation of maximum fuelling for a given engine speed is based on experimental calibration of test engine(s). The calibrated maximum fuelling would normally be set at slightly lower than the test results indicated to provide a margin of safety to ensure that an overly rich mixture was not obtained. However, in actual operation, airflow to the engine may be higher than the experimental data indicated, particularly under transient conditions. This may result in the air fuel ratio in the combustion chamber being less than that for which maximum power can be obtained. At wide open throttle, for example, air flow is at its maximum, but maximum fuelling corresponding to the air flow may not be supplied due to the calibrated maximum fuelling rates, reducing the power output of the engine.

Whilst fuel led control is necessary for low engine loads/speeds, this may not be so for higher load/speed conditions. In certain engines, such as the applicant's two stroke direct injected crankcase scavenged engine, there is a substantially monotonically increasing relationship between the fuelling rate and the air flow rate at higher loads. Under these loads it is possible, and preferable as discussed above, to use air led control of the fuelling rate.

The major difficulty that arises with such an arrangement is that there can be a discontinuity at the point of transition between the two control methods. The fuelling rate determined under fuel led control could be significantly different to the fuelling rate determined under air led control at the point where the engine management system transfers between the two fuelling rate control methods. This can cause a step change in the determined fuelling rate resulting in a step change in torque. Such sudden changes may be detrimental to engine control and are undesirable as they may result in jolting through the drive train of the vehicle producing, for example, an uncomfortable ride for the occupants of the vehicle.

It is therefore an object of the present invention to provide an improved method of controlling the fuelling rate of an engine.

With this in mind, the present invention provides a method of controlling the fuelling rate for an internal combustion engine including:

(a) controlling the fuelling rate in a fuel led control mode whereby the fuelling rate is controlled as a function of the operator demand on the engine during at least a portion of low engine load operation;

(b) controlling the fuelling rate in an air led control mode whereby the fuelling rate is controlled as a function of the air flow rate to the engine during at least a portion of medium to high engine load operation;

(c) providing a point of transition between the two control modes whereat each control mode provides substantially the same predetermined fuelling rate.

As the point of transition between the two control modes occurs when the fuelling rate determined by either control mode reaches substantially the same predetermined threshold fuelling rate, there can therefore be a smooth transition in the fuelling rate when transferring between the two control modes.

The predetermined threshold-fuelling rate may be determined from a look up map depending on current engine speed, so that for a given engine speed the transition point will be at a fixed fuelling rate.

As noted above, at low loads, the airflow rate cannot be used to determine the engine load because for a given airflow rate, there may not be a unique corresponding fuelling rate. Where the engine operation is controlled by an electronic control unit (ECU) it is not possible to provide a map whereby a fuelling rate can be looked up on the basis of a given air flow rate. In this situation, a fuel led control mode for the fuelling rate is more appropriate. At medium to high loads, where there is a substantially monotonically increasing airflow rate for increasing fuel flow rate, a unique fuelling rate is therefore available for any given airflow rate at these loads, and the fuelling level can be determined on the basis of the current airflow. An air led control mode for the fuelling rate is more appropriate in this situation.

The predetermined threshold fuelling rate for transition between control modes is preferably set above fuelling levels where a single air flow rate can correspond to more than one fuelling level which occur at low loads. A margin of variation may be provided about this value to allow for any errors or system anomalies.

The engine air intake may be provided with a secondary valve such as that described in the applicant's U.S. Pat. No. 5,251,597, known commonly as a DAR-valve. The DAR-valve is an electronically controlled air flow control valve which is provided additionally to the primary air flow control valve, and provides a separately controllable airflow to the engine. In the above-mentioned U.S. patent, there is described a system wherein the primary air flow control device is a butterfly valve controlled directly by operator movement of an accelerator pedal. The DAR-valve in this situation is able, under the control of the electronic control unit (ECU), to selectively add to the volume of air provided by the primary valve device. As such, total air flow to the engine is controlled by the ECU. The DAR-valve may be used to ensure that air flow in the air led region at the transition point is at such a level that correct fuelling is provided. At higher loads, where the majority of the bulk air is provided through the primary valve (usually a butterfly valve), the ability of the DAR-valve to control air flow is diminished. As such, it is preferable to preset the transition point such that DAR-valve is in its region of authority, that is, still being effective in controlling the air flow rate through the inlet manifold to the requisite degree that the air flow may be controlled if the air flow is different to that required for the fuelling rate obtained under fuel led control. This may therefore avoid a step jump in the fuelling rate at the point of transition.

In other embodiments, the primary air flow control device may be electronically controlled, and this control can be used in a similar fashion to the above described DAR-valve air flow control method. One benefit of the use of an electronically controlled primary air flow device is that there is no problem with the "region of authority" as the primary valve obviously has authority throughout the operating range of the engine.

According to the present invention, a "demand" fuelling rate may initially be determined as a function of the load demand and the engine speed. The load demand may be determined as a function of operator pedal position. To this end, an electronic engine management system may be provided including a look-up map having the demand fuelling rate plotted against the coordinates of pedal position and engine speed. This map is referred to as the "pedal" map and provides the demand fuelling rate.

A censored air/fuel ratio referred to above may be obtained from a further look-up map setting predetermined minimum limits to the air/fuel ratio as a function of the engine speed and demand fpc. A censor fuelling rate may then be determined by dividing the air flow to the engine, measured for example by an air flow meter, by the obtained censor air/fuel ratio. This censor fuelling rate may be compared with the demand fuelling rate obtained from the pedal map. If the demand fuelling rate is greater than the censor fuelling rate, then the total fuelling rate (or delivered fpc) value may be set as being equal to the censor fuelling rate. However, if the demand fuelling rate is less than the censor fuelling rate, then the total fuelling rate may be set as being equal to the demand fuelling rate. This process is known as censoring the fuelling rate.

The total fuelling rate (following censoring) may then be compared with a predetermined threshold fuelling rate value. If the total fuelling rate is less than the threshold fuelling rate value, then the total fuelling rate obtained above may be selected as the actual-fuelling rate delivered to the engine. However, if the total fuelling rate is greater then the threshold fuelling rate value, then an air led fuelling rate value may be obtained from a further look-up map plotting air led fuelling rate against the coordinates of measured air flow rate and engine speed. The total fuelling rate may then be set as being equal to the determined air led fuelling rate and air led operation is commenced without a sudden shift in fuelling rate or overall torque.

The shift from fuel to air led operation, or air to fuel led operation, requires a change in basic operation of the engine and electronic control unit. As such, it would be undesirable to allow rapid changes between modes of operation. Such rapid changes in mode of operation could result, for example, from continuous engine operation at around the transition point. One method of preventing such rapid changes would be to provide a delay following a change of mode before allowing a return change of mode, such a delay would only need to be very short (around half a second, for example) to obtain the desired results.

A preferred method would be to set the transition point for transition from fuel led mode to air led mode at a greater fuelling level than the transition point for transition from air led mode to fuel led mode. This would mean that fuelling level would have to be reduced by a given amount from its value at the point of transition from fuel led to air led (which would only occur if fuelling level were increasing) before a subsequent transition from air led to fuel led operation would be possible.

It will be convenient to further describe the invention by reference to the accompanying drawings which illustrate a preferred embodiment of the invention. Other arrangements of the invention are possible and consequently, the particularity of the accompanying drawings is not to be understood as superseding the generality of the preceding description of the invention.

Figure 2:
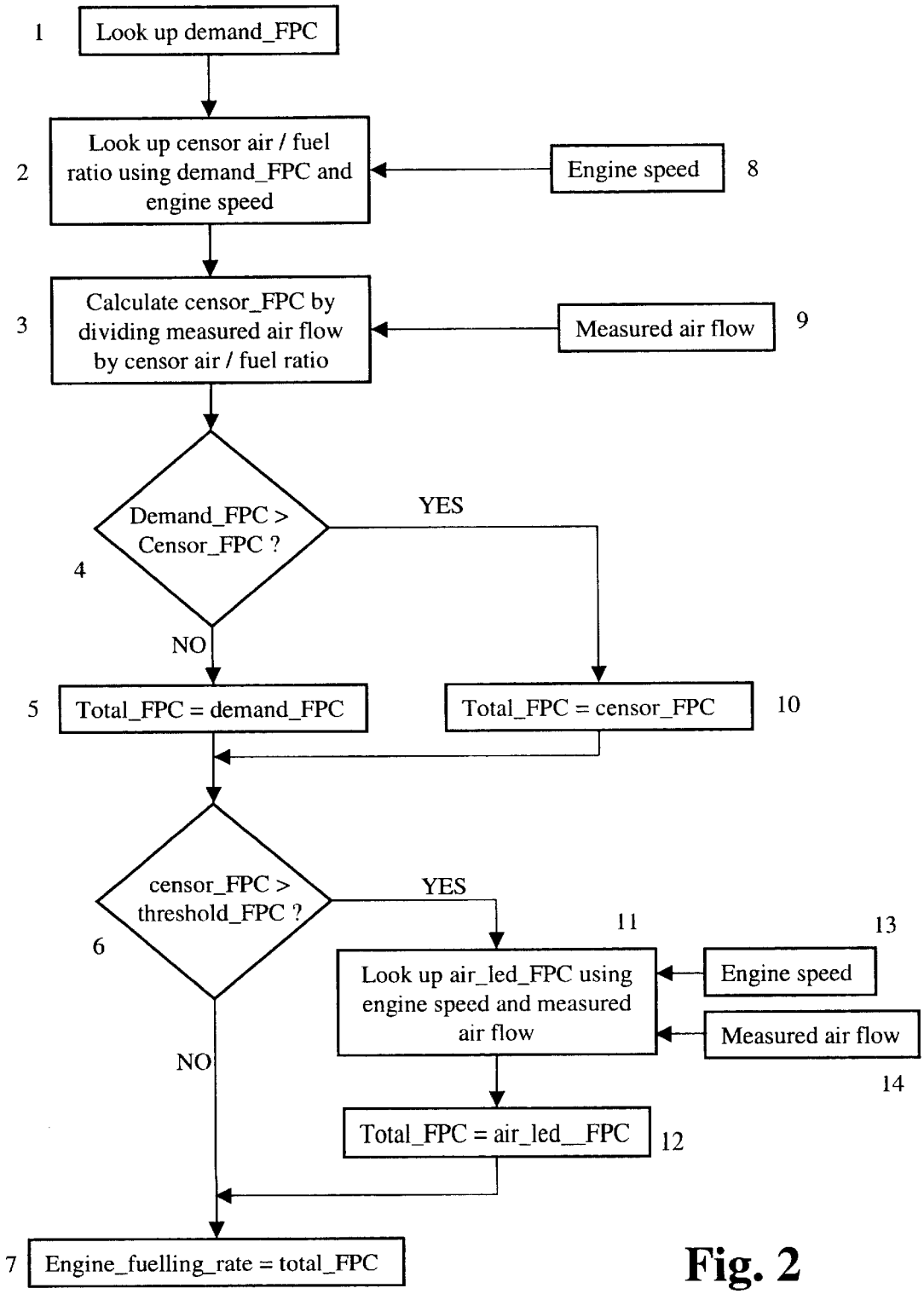

In the drawings:

FIG. 1 is a graph showing a typical relationship between the fuelling rate and the airflow rate in a fuel injected two stroke crankcase scavenged internal combustion engine; and FIG. 2 is a flow chart showing the control strategy according to the present invention.

Referring initially to FIG. 1, the graph shows a typical relationship of the fuelling rate, referred to as "total FPC" and the airflow rate, referred to as APC. Curve C shows the change in the airflow rate as a function of the increase in fuelling rate. At low engine loads, the airflow rate can initially decrease with increasing fuelling rate before subsequently increasing in a monotonic fashion at higher engine loads. At such low engine loads, two fuelling rate values can therefore correspond to a single air flow rate. It should be noted that alternative graph plot shapes at low load other than the shape shown in FIG. 1 are possible. For example, the graph plot may be straight or even undulating at the low load end thereof. Therefore, fuel led control of the fuelling rate is required to the left of dotted line A. Air led control of the fuelling rate can be utilised to the right of dotted line A because of the monotonic increase in the air flow rate against the fuelling rate. The transition point B on curve C between the fuel led and air led regions is determined as a fixed predetermined total fuelling rate. Once the fuelling level has reached this transition point B, the control system converts to air led and vice versa for descending fuelling rates.

This predetermined total fuelling rate B is set so that it is above the region where more than one fuelling rate can correspond to a single air flow rate, being the region to the left of dotted line X. Some variation around the fixed predetermined total fuelling rate is allowed for error or any system anomaly.

The predetermined total fuelling rate is also set such that a DAR valve controlling the bypass line in the inlet manifold of the engine can still effectively control the air flow through the inlet manifold such that control of the airflow if the airflow is above or below the required fuel led fuelling rate value is still possible. This will avoid any step jump in the fuelling rate as the transition occurs. The region of effective DAR valve control of the airflow to the left of dotted line E can be known as the region of authority of the DAR valve.

FIG. 2 shows the control strategy according to the present invention. At step 1, a demand fuelling rate or "demand_FPC" is obtained from a pedal map plotting demand_FPC against the co-ordinates of engine speed and pedal position.

At step 2, a censor air/fuel ratio can be obtained from a further look-up map. In step 2, this look-up map plots the censor air/fuel ratio as a function of the engine speed determined at step 8 and demand_FPC calculated at step 1. A censor fuelling rate or censor_FPC is then determined by dividing the actual air flow to the engine measured by for example an air flow meter with the obtained censor air/fuel ratio.

At step 4, the demand_FPC is compared with the censor_FPC. If the demand_FPC is less than or equal to the censor_FPC, then a total fuelling rate or total_FPC is set as being equal to demand_FPC at step 5. If the demand_FPC is greater than the censor_FPC, then a total_FPC is set as being equal to the censor _FPC at step 10.

At step 6, the censor_FPC is compared against a threshold fuelling rate value, known as the "threshold_FPC" at which the transition between fuel led and air led control is set. If the censor_FPC is less than or equal to the threshold_FPC, then the total_FPC obtained previously will become the actual fuelling rate delivered to the engine as shown at step 7. However, if the censor_FPC is greater than the threshold FPC, then an air led control map is referred to in step 11, the look-up map plotting the air led fuelling rate or "air led FPC" against the co-ordinates of engine speed obtained at step 13 and the measured air flow rate obtained at step 14. The total_FPC is then set at the air led FPC at step 12, this total_FPC being the actual fuelling rate delivered to the engine at step 7.

As the fuelling rate is modified by censoring in fuel led mode, and modified by air flow control in air led mode, a step change in the fuelling rate at the transition between fuel led control and air led control is avoided. This system avoids the need for a transition period over which there is some interpolation of the fuelling values of air led control and fuel led control to provide a smooth transition.

Although the present invention is described-with respect to a fuel injected two stroke engine, it is also envisaged that the present invention be applicable to other types of engines, in particular those having an air flow/fuel delivery characteristic similar to that of FIG. 1. That is, having non-unique air flow rates for any given fuelling rate.

The claims defining the invention are as follows:

1. An electronic control unit (ECU) for controlling operation of an internal combustion engine over a range of operating conditions between low engine load operating conditions and high engine load operating conditions, the ECU programmed to:

(a) provide for operation of said engine according to a fuel led control mode wherein fuelling rates for said engine are selected by said ECU as a function of operator demand and air flow to said engine is adjusted by said ECU according to said fuelling rate;

(b) provide for operation of said engine according to an air led control mode wherein fuelling rates for said engine are selected by said ECU as a function air flow to the engine, said air flow adjusted in accordance with operator demand;

(c) operate said engine in said fuel led mode during at least part of a low engine load portion of said range of operating conditions;

(d) operate said engine in said air led mode during at least part of a medium to high engine load portion of said range of operating conditions;

(e) provide at least one transition point between the two control modes such that at said transition point each control mode provides substantially the same predetermined fuelling rate.

2. An ECU according to claim 1 including said ECU determining a threshold fuelling rate as a function of engine speed so that, for a given engine speed, said transition between said control modes is at a fixed fuelling rate.

3. A method according to claim 1 wherein said ECU provides a threshold fuelling rate for said transition between said control modes, said threshold being set above fuelling levels where a single air flow rate can correspond to more than one fuelling level at low engine load operation.

4. A method according to claim 1 including said ECU determining a threshold fuelling rate as a function of engine speed so that, for a given engine speed, said transition between control modes is at a fixed fuelling rate and wherein the threshold fuelling rate is set above fuelling levels where a single air flow rate can correspond to more than one fuelling level at low engine load operation.

5. An ECU according to claim 1 wherein said ECU determines load demand as a function of an operator pedal position, the demand fuelling rate being a function of the pedal position and the engine speed.

6. An ECU according to any one of claims 1–4, wherein said ECU controls primary air flow to the engine by adjusting an electronically controlled air flow device.

7. An ECU according to any one of claims 1–4, wherein the engine further includes a DAR-valve for assisting in the control of the air flow rate into the engine, wherein said transition between said control modes is within a region of air flow control authority of the DAR-valve.

8. An ECU according to any one of claims 1–4 said ECU:

(a) determining a demand fuelling rate as a function of the load demand on the engine and the engine speed;

(b) determining a censored air fuel ratio for setting predetermined minimum limits to the air fuel ratio as a function of the engine speed and demand fuelling rate;

(c) determining a censor fuelling rate by dividing the actual measured air flow to the engine by the obtained censor air fuel ratio;

(d) comparing the censor fuelling rate with the demand fuelling rate;

(e) setting a total fuelling rate delivered to the engine as being equal to the censor fuelling rate if the demand fuelling rate is greater than censor fuelling rate; or setting a total fuelling rate delivered to the engine as being equal to the demand fuelling rate if the demand fuelling rate is less than the censor fuelling rate;

(f) comparing the total fuelling rate with a predetermined threshold fuelling rate value;

(g) selecting the total fuelling rate to be the actual fuelling rate to be delivered to the engine if the total fuelling rate is less than the threshold fuelling rate value; or obtaining an air led fuelling rate value as a function of the measure air flow rate and the engine speed if the total fuelling rate is greater than the threshold fuelling rate value, such that the actual fuelling rate to be delivered to the engine is equal to the determined air led fuelling rate.

9. An ECU according to any one of claims 1–4, wherein the fuelling level for the transition from fuel led control to air led control is greater than the fuelling level for the transition from air led control to fuel led control.

10. A method of controlling the fuelling rate for an internal combustion engine over a range of operating conditions between low engine load operating conditions and high engine load operating conditions, the method including:

(a) a fuel led control mode wherein fuelling rate is selected as a function of operator demand and air flow to said engine is adjusted according to said fuelling rate;

(b) an air led control mode wherein fuelling rate is controlled as a function of air flow to the engine and wherein air flow to the engine is adjusted in accordance with operator demand;

(c) operating said engine in said fuel led mode during at least part of a low engine load portion of said range of operating conditions;

(d) operating said engine in said air led mode during at least part of a medium to high engine load portion of said range of operating conditions; and (e) providing at least one transition point between the two control modes such that at said transition point each control mode provides substantially the same predetermined fuelling rate.

11. A method according to claim 10 including determining a threshold fuelling rate as a function of engine speed so that, for a given engine speed, said transition point between said control modes is at a fixed fuelling rate.

12. A method according to claim 10 wherein a threshold fuelling rate is provided for said transition point between said control modes, said threshold being set above fuelling levels where a single air flow rate can correspond to more than one fuelling level at low engine load operation.

13. A method according to claim 10 further including:

determining a threshold fuelling rate as a function of engine speed so that, for a given engine speed, the transition point is at a fixed fuelling rate and wherein the threshold fuelling rate is set above fuelling levels where a single air flow rate can correspond to more than one fuelling level at low engine load operation.

14. A method according to any one of claims 10–13 wherein primary air flow to the engine is controlled by an electronically controlled air flow device.

15. A method according to any one of claims 10–13, wherein the engine further includes a DAR-valve for assisting in the control of the air flow rate into the engine, and wherein said transition between said control modes is within a region of air flow control authority of the DAR-valve.

16. A method according to any one of claims 10–13 wherein the fuelling level for the transition from fuel led control to air led control is greater than the fuelling level for the transition from air led control to fuel led control.

17. A method according to any one of claims 10–13 including:

(a) determining a demand fuelling rate as a function of the load demand on the engine and the engine speed;

(b) determining a censored air fuel ratio for setting predetermined minimum limits to the air fuel ratio as a function of the engine speed and demand fuelling rate;

(c) determining a censor fuelling rate by dividing the actual measured air flow to the engine by the obtained censor air fuel ratio;

(d) comparing the censor fuelling rate with the demand fuelling rate;

(e) setting a total fuelling rate delivered to the engine as being equal to the censor fuelling rate if the demand fuelling rate is greater than censor fuelling rate; or setting a total fuelling rate delivered to the engine as being equal to the demand fuelling rate if the demand fuelling rate is less than the censor fuelling rate;

(f) comparing the total fuelling rate with a predetermined threshold fuelling rate value;

(g) selecting the total fuelling rate to be the actual fuelling rate to be delivered to the engine if the total fuelling rate is less than the threshold fuelling rate value; or obtaining an air led fuelling rate value as a function of the measure air flow rate and the engine speed if the total fuelling rate is greater than the threshold fuelling rate value, such that the actual fuelling rate to be delivered to the engine is equal to the determined air led fuelling rate.

18. A method according to claim 17 wherein the load demand is determined as a function of an operator pedal position, the demand fuelling rate being a function of the pedal position and the engine speed.

* * * * *